US012471666B2

(12) United States Patent
Oudshoorn et al.

(10) Patent No.: US 12,471,666 B2
(45) Date of Patent: Nov. 18, 2025

(54) SHOE SOLE

(71) Applicant: Inoveight Limited, Staveley (GB)

(72) Inventors: Bodil Yucki Oudshoorn, Kendal (GB); Luke Mcconnie, Staveley (GB); Phil Rees, Derby (GB)

(73) Assignee: Inoveight Limited, Staveley (GB)

( * ) Notice: Subject to any disclaimer, the term of this patent is extended or adjusted under 35 U.S.C. 154(b) by 140 days.

(21) Appl. No.: 17/777,151

(22) PCT Filed: Nov. 18, 2020

(86) PCT No.: PCT/GB2020/052946
§ 371 (c)(1),
(2) Date: May 16, 2022

(87) PCT Pub. No.: WO2021/099785
PCT Pub. Date: May 27, 2021

(65) Prior Publication Data
US 2022/0395055 A1 Dec. 15, 2022

(30) Foreign Application Priority Data
Nov. 18, 2019 (GB) ..... 1916783

(51) Int. Cl.
*A43B 13/14* (2006.01)
*A43B 13/18* (2006.01)

(52) U.S. Cl.
CPC ..... *A43B 13/141* (2013.01); *A43B 13/181* (2013.01)

(58) Field of Classification Search
CPC ..... A43B 3/0063; A43B 3/0068
See application file for complete search history.

(56) References Cited

U.S. PATENT DOCUMENTS 4,777,738 A * 10/1988 Giese ..... A43B 5/08 D2/953
5,384,973 A 1/1995 Lyden
(Continued)

FOREIGN PATENT DOCUMENTS

CN 101959435 A 1/2011
EP 1906783 B1 * 9/2012 ..... A43B 13/10
(Continued)

OTHER PUBLICATIONS

Finn Bojsen-Moller, Calcaneocuboid joint and stability of the longitudinal arch of the foot at high and low gear push off, Jul. 10, 1978, J. Ant. (1979), 165-176.
(Continued)

*Primary Examiner* — Jameson D Collier
(74) *Attorney, Agent, or Firm* — Workman Nydegger

(57) ABSTRACT

A sole structure for a shoe having a bottom surface includes a forefoot sole portion, arranged towards a distal end along a longitudinal central axis of the sole structure; a rearfoot sole portion, arranged towards a proximal end along the longitudinal central axis of the sole structure; and an articulation portion, adapted to operably couple the forefoot sole portion and the rearfoot sole portion, so as to allow relative movement between the forefoot sole portion and the rearfoot sole portion matching the triplanar movement provided by the midtarsal joint in any one of the frontal, sagittal and transverse plane of the foot, during use.

19 Claims, 10 Drawing Sheets

(56) References Cited

U.S. PATENT DOCUMENTS

| | | | | |
|---|---|---|---|---|
| 5,425,184 | A | 6/1995 | Lyden et al. | |
| 5,625,964 | A * | 5/1997 | Lyden | A43B 13/20 36/114 |
| 7,225,564 | B1 * | 6/2007 | Gillespie | A43B 3/30 36/35 R |
| D686,406 | S * | 7/2013 | Spring | D2/951 |
| D858,056 | S * | 9/2019 | Tæstensen | D2/951 |
| 2008/0229617 | A1 * | 9/2008 | Johnson | A43B 3/0057 36/102 |
| 2009/0293314 | A1 * | 12/2009 | Dekovic | A43B 13/186 36/103 |
| 2010/0011622 | A1 * | 1/2010 | Abadjian | A43B 13/223 36/114 |
| 2010/0293816 | A1 | 11/2010 | Truelsen | |
| 2010/0299965 | A1 * | 12/2010 | Avar | A43B 5/06 36/102 |
| 2011/0126428 | A1 * | 6/2011 | Hazenberg | A43B 13/122 36/12 |
| 2012/0233885 | A1 * | 9/2012 | Shaffer | A43B 13/20 36/83 |
| 2013/0152428 | A1 | 6/2013 | Bishop et al. | |
| 2013/0232821 | A1 | 9/2013 | Schindler | |
| 2014/0041261 | A1 * | 2/2014 | Walker | A43B 13/223 36/25 R |
| 2014/0373396 | A1 | 12/2014 | Chang | |
| 2015/0052781 | A1 * | 2/2015 | Hatfield | A43C 15/02 36/25 R |
| 2015/0250260 | A1 * | 9/2015 | Bessho | A43B 7/18 36/25 R |
| 2016/0015120 | A1 * | 1/2016 | Denison | A43B 3/0094 36/114 |
| 2016/0219973 | A1 * | 8/2016 | Cheney | A43B 13/38 |
| 2017/0042283 | A1 * | 2/2017 | Nakaya | A43B 13/04 |
| 2017/0150782 | A1 * | 6/2017 | Moriyasu | A43B 13/181 |
| 2018/0000191 | A1 * | 1/2018 | Bacon | A43B 5/00 |
| 2018/0199666 | A1 | 7/2018 | Moriyasu et al. | |
| 2018/0295935 | A1 * | 10/2018 | Giandolini | A43B 13/141 |
| 2019/0110549 | A1 | 4/2019 | Hatfield | |
| 2020/0113273 | A1 * | 4/2020 | Aubonnet | A43B 13/223 |
| 2021/0177087 | A1 | 6/2021 | Truelsen et al. | |

FOREIGN PATENT DOCUMENTS

| | | | |
|---|---|---|---|
| GB | 2513096 | 10/2014 | |
| JP | 2010-504839 | 2/2010 | |
| WO | WO-2019073609 A1 * | 4/2019 | A43B 13/141 |
| WO | 2019/141735 | 7/2019 | |

OTHER PUBLICATIONS

Search Report for GB 1916783.2 dated May 28, 2020.

Written Opinion and International Search Report for PCT/GB2020/052946 mailed Feb. 17, 2021.

Cui Lina, "Foot physiological movement analysis and functional material design of jogging shoes", Western Leather, vol. 33, No. 15, Dec. 31, 2011, pp. 34-37.

* cited by examiner (a)

(b)

(c)

(a)

(b)

(a) (b) (c)

(d)

(a)

(b)

SHOE SOLE

CROSS-REFERENCE TO RELATED APPLICATIONS

The present application is a 35 U.S.C. § 371 U.S. National Stage of International Application No. PCT/GB2020/052946, filed on Nov. 18, 2020, which claims priority to Great Britain Patent Application No. 1916783.2, filed Nov. 18, 2019, the entire content of each of which is incorporated herein by reference.

The present invention relates to shoe soles, as well as, athletic shoes incorporating such soles. In particular, the invention relates to a shoe sole structure adapted for improved performance and energy efficiency, due to its ability to conform to anatomically natural foot movement during walking and running over any terrain.

INTRODUCTION

A shoe, such as, for example, an athletic shoe, usually includes an upper and a sole structure. The upper provides a covering, as well as, the structure for attachment to the foot. The sole structure is usually secured to a lower portion of the upper and is positioned between the foot and the ground, so as to mostly protect and cushion the foot during walking, running or any other foot related activities. However, the sole structure may influence the foot's function (e.g. resisting supination or pronation) by limiting its natural movement during walking and running, especially when negotiating uneven terrain.

Foot Anatomy

As illustrated in FIG. 1, by virtue of the unusual anatomy, movement of the foot uses special definitions and reference planes. For example, motion within the sagittal plane 10 is known as dorsiflexion (upward) and plantar flexion (downward), motion within the frontal plane 12 is known as inversion (adduction) and eversion (abduction), and motion within the transverse plane 14 is known as adduction, or internal rotation of the foot when the distal part of the foot moves toward the midline of the leg on its vertical axis. Also, because the mechanical axes of the foot are not perpendicular to any of the cardinal planes, all motion is essentially triplanar, although, in some cases uniaxial.

FIG. 2 shows a simplified illustration of the foot's skeletal bone structure (a) from a lateral side view and (b) from a dorsal top view.

The ankle joint 16 is a synovial articulation between the inferior aspect of the tibia 18 and fibula 20, and the superior surface of the talus 22. Even though the ankle joint 16 is uniaxial and is often described as a pure plantar flexor and dorsiflexor, its axis is actually oblique, a factor that predominantly results in pronation and supination (i.e. a combination of all three movement). Thus, dorsiflexion of the ankle joint 16 while the foot is fixed causes internal rotation of the tibia 18 and pronation of the foot.

The subtalar joint 24 consists of a gliding articulation between the talus 22 and the calcaneus 26. The axis of the subtalar joint 24 runs downward, posteriorly and laterally, at a mean angle of 41° from the horizontal plane and is 23° rotated from the long axis of the foot, thus, its motion is more equally triplanar than that of the ankle joint 16. Therefore, the axis of the subtalar joint 24 is analogous to an oblique hinge (see FIG. 3 in particular), i.e. when rotation is imparted to the superior aspect of the talus 22, it causes rotation of the calcaneus 26 in the opposite direction.

External rotation of the leg produces inversion of the calcaneus 26, and internal rotation causes eversion of the calcaneus 26.

FIG. 3 illustrates schemata of mechanisms by which the rotation of the tibia 18 is transmitted through the subtalar joint 24 into the foot, (a) outward rotation of the upper stick 28 results in inward rotation of the lower stick 30, thus, outward rotation of the tibia 18 causes inward rotation of the calcaneus 26 and subsequent elevation of the medial border and depression of the lateral border of the foot, as illustrated in (c). In (b), inward rotation of the upper stick 28 results in outward rotation of lower stick 30, thus, inward rotation of tibia 18 causes outward rotation of calcaneus 26 and depression of medial side of the border and elevation of lateral border of the foot, as illustrated in (d).

Referring now to FIG. 4, the midtarsal joint 32 (also known as transverse tarsal joint) is a combination of the calcaneocuboid and talonavicular synovial gliding joints (navicular 34, cuboid 36), where (a) is a partial lateral side view and (b) is a partial dorsal top view. Thus, the midtarsal joint 32 has two independent axes of motion, the oblique midtarsal joint axis 38 (O.M.J.A.) and the longitudinal midtarsal joint axis 40 (L.M.J.A.), each one of which is a supination-pronation axis, where the L.M.J.A. 40 angles 15° from the transverse plane and 9° from the sagittal plane, and the O.M.J.A. 38 angles (on average) 52° from the transverse plane and 57° from the sagittal plane 10 (with anthropometric variation in either direction). Each one of the two midtarsal joint axes 38, 40 allows movement in one plane only (i.e. one degree of freedom), but because each axis angles with respect to the three body planes, supination-pronation motion occurs.

Based on these three major foot joints alone, it is clear that the complex triplanar motion within the skeletal foot structure is absolutely essential for the foot's ability to adapt to different surfaces, provide leverage for propulsion, but also feedback awareness of joint and body position for balance.

It is commonly accepted that currently available shoe designs appear to either focus on cushioning and comfort or use typically stiff sole structures to improve wear resistance, instead of synergeticly enhancing the natural ability of the foot and natural gait. Thus, such shoe designs are likely to affect the mobility and functionality of any one of the discussed foot joints, so that the foot's ability to adapt to uneven terrain is compromised. In particular, when traversing uneven or changing topography, either running or walking, it is sometimes necessary for parts of the foot to rotate and, as such, change its position relative to any one of the other foot parts, such as, for example, the ability of the forefoot to invert (i.e. twist inward) without affecting the orientation of the rearfoot. As discussed previously, this 'anatomically natural' function is provided by the oblique midtarsal joint via its O.M.J.A. 38 that serves as an isolation axis between the forefoot and the rearfoot.

Accordingly, it is an object of the present invention to provide a sole structure and shoe suitable to perform in synergy with the articulation mechanisms provided by the unique anatomy of the foot.

SUMMARY OF THE INVENTION

Preferred embodiments of the invention seek to overcome one or more of the above disadvantages of the prior art.

According to a first aspect of the present invention, there is provided a sole structure for a shoe having a bottom surface, comprising:

a forefoot sole portion, arranged towards a distal end along a longitudinal central axis of said sole structure;

a rearfoot sole portion, arranged towards a proximal end along said longitudinal central axis of said sole structure;

an articulation portion, adapted to operably couple said forefoot sole portion and said rearfoot sole portion, so as to allow relative movement between said forefoot sole portion and said rearfoot sole portion matching the triplanar movement provided by the midtarsal joint in any one of the frontal, sagittal and transverse plane of the foot, during use.

This provides the advantage of a shoe sole and shoe that is able to synergeticly follow the natural movement of the foot during walking and running, i.e. the sole structure is able match the complex mobility of the foot in line with at least one joint axis (i.e. o.m.j.a) of the midtarsal joint. Therefore, the foot using a shoe and sole structure of the present invention is able to move as it has been designed anatomically and without inhibition, because the sole structure of the present invention is adapted to mimic the triplanar motion provided within the foot. Further, a more local adaptation of the sole to the terrain may minimise the energy expenditure of the muscles involved as less forces coming from uneven terrain will have to be absorbed by these muscles. In addition, the functional decoupling of the forefoot and the rearfoot may provide the advantage of a reduced lateral strain on the ankle joint, potentially minimising the risk of ankle injuries.

Advantageously, said articulation portion may be arranged within a predetermined region of said sole structure that is substantially defined by a 2D (two-dimensional) projection of the oblique midtarsal joint axis onto said sole structure, during use.

Advantageously, said articulation portion may comprise at least one groove structure extending from a medial side to a lateral side of said predetermined region of said sole structure at an angle in the range of 40° to 80° relative to said longitudinal centre axis.

Preferably, said angle may be in the range of 50° to 70° relative to said longitudinal central axis. Even more preferably, said angle may be about 60° relative to said longitudinal centre axis.

Advantageously, said at least one groove structure may be defined by a predetermined width and a predetermined depth, each one configured to allow anatomically correct movement between said forefoot sole portion and said rearfoot sole portion, during use.

Advantageously, said at least one groove structure may be provided on a bottom surface of said sole structure. Preferably, said at least one groove structure may have a substantially inverted U-shaped or inverted V-shaped cross section.

Advantageously, said articulation portion may be configured to provide for inversion and/or eversion movement of said forefoot sole portion independent of said rearfoot sole portion.

Advantageously, said articulation portion may comprise a pivot joint having an axis of rotation parallel to the normal projection of the oblique midtarsal joint axis of the foot onto said bottom surface, during use.

Advantageously, the sole may further comprise at least one flexure member arranged in a direction substantially along said longitudinal axis and operably coupled with said articulation portion. Preferably, said at least one flexure member may be a flexure groove structure extending from said forefoot sole portion towards and at least mergingly into said articulation portion. Additionally, said flexure groove structure may extend from said forefoot sole portion, crossing said articulation portion and into said rearfoot sole portion.

Advantageously, each one of said at least one flexure member is operably aligned with a predetermined anatomical feature of the foot. Preferably, the predetermined anatomical feature of the foot may be a feature responsible for a specific motion within the foot.

This provides the advantage of a sole structure particularly adapted to mimic the anatomical movement of the foot, during use. The one or more flexure members (or flexure grooves) are configured and arranged so as to allow different sections of the sole to easily and individually follow a respective anatomical region of the foot during movement.

BRIEF DESCRIPTION OF THE DRAWINGS

Preferred embodiments of the present invention will now be described, by way of example only and not in any limitative sense, with reference to the accompanying drawings, in which.

DETAILED DESCRIPTION OF THE PREFERRED EMBODIMENT(S)

Figure 1:
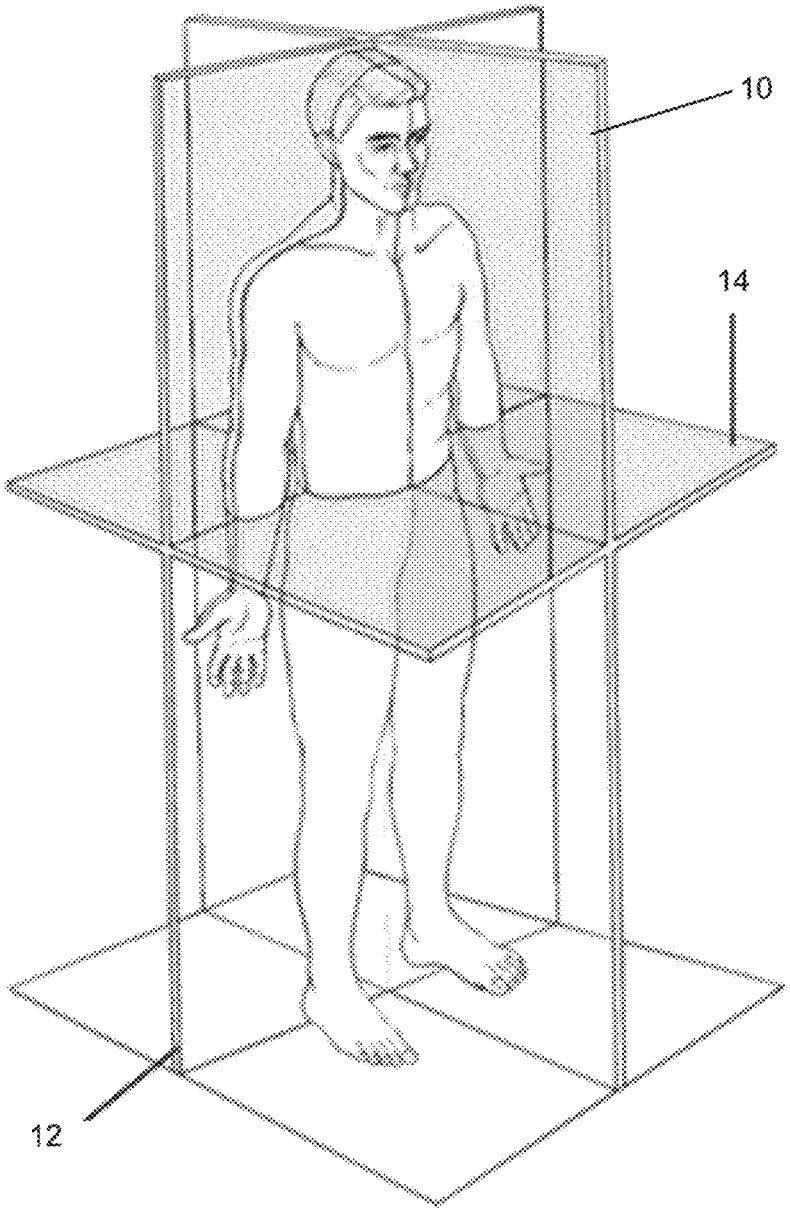
FIG. 1 shows an illustration of the three anatomical planes, the sagittal plane, the frontal plane and the transverse plane.
Figure 2:
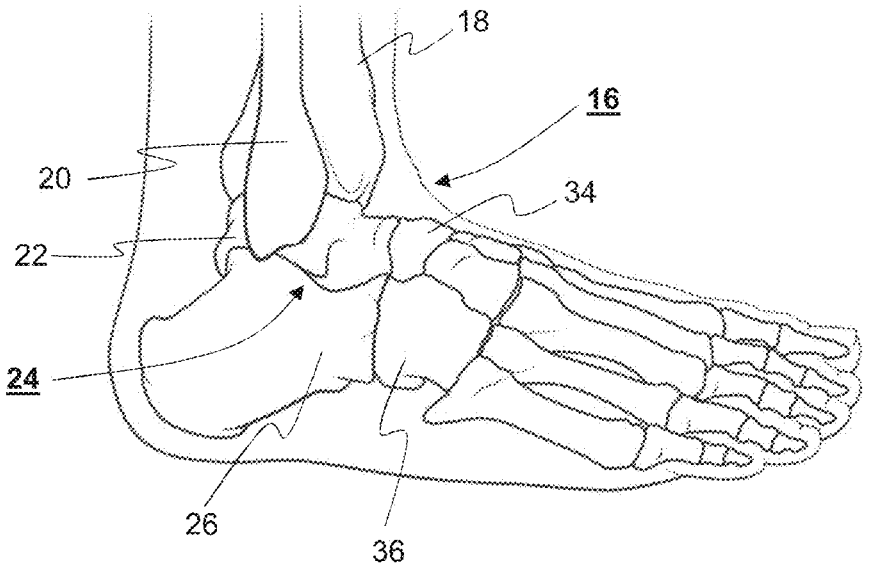
FIG. 2 shows (a) a lateral side view and (b) a dorsal top view of the skeletal bone structure of a foot, as well as, (c) a perspective view of a partial foot and ankle joint.
Figure 2:
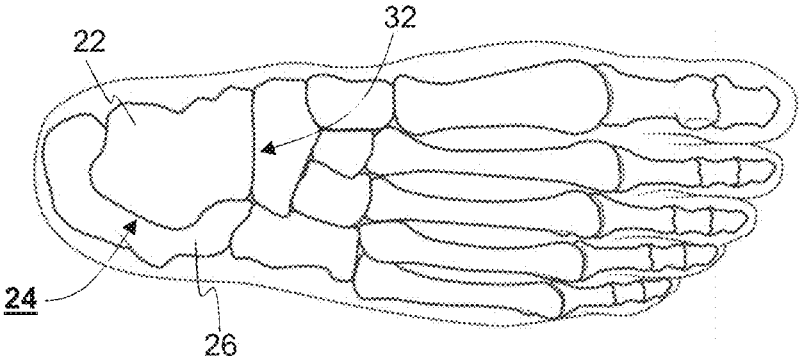
Figure 2:
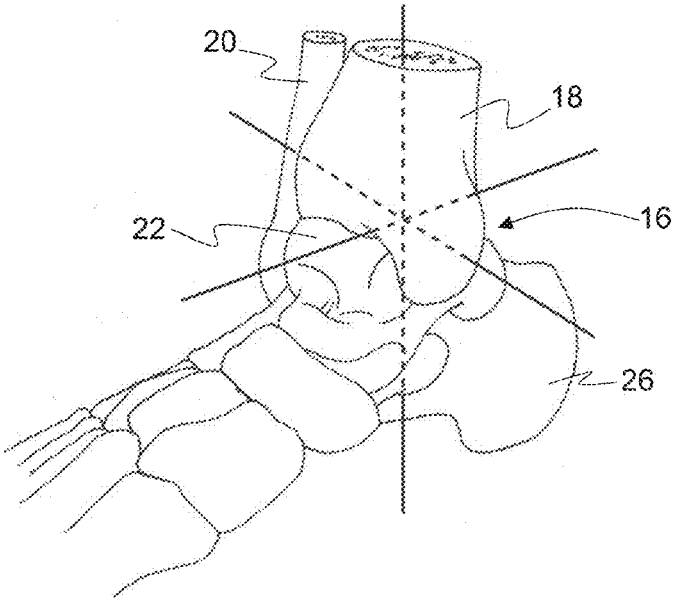
Figure 3:
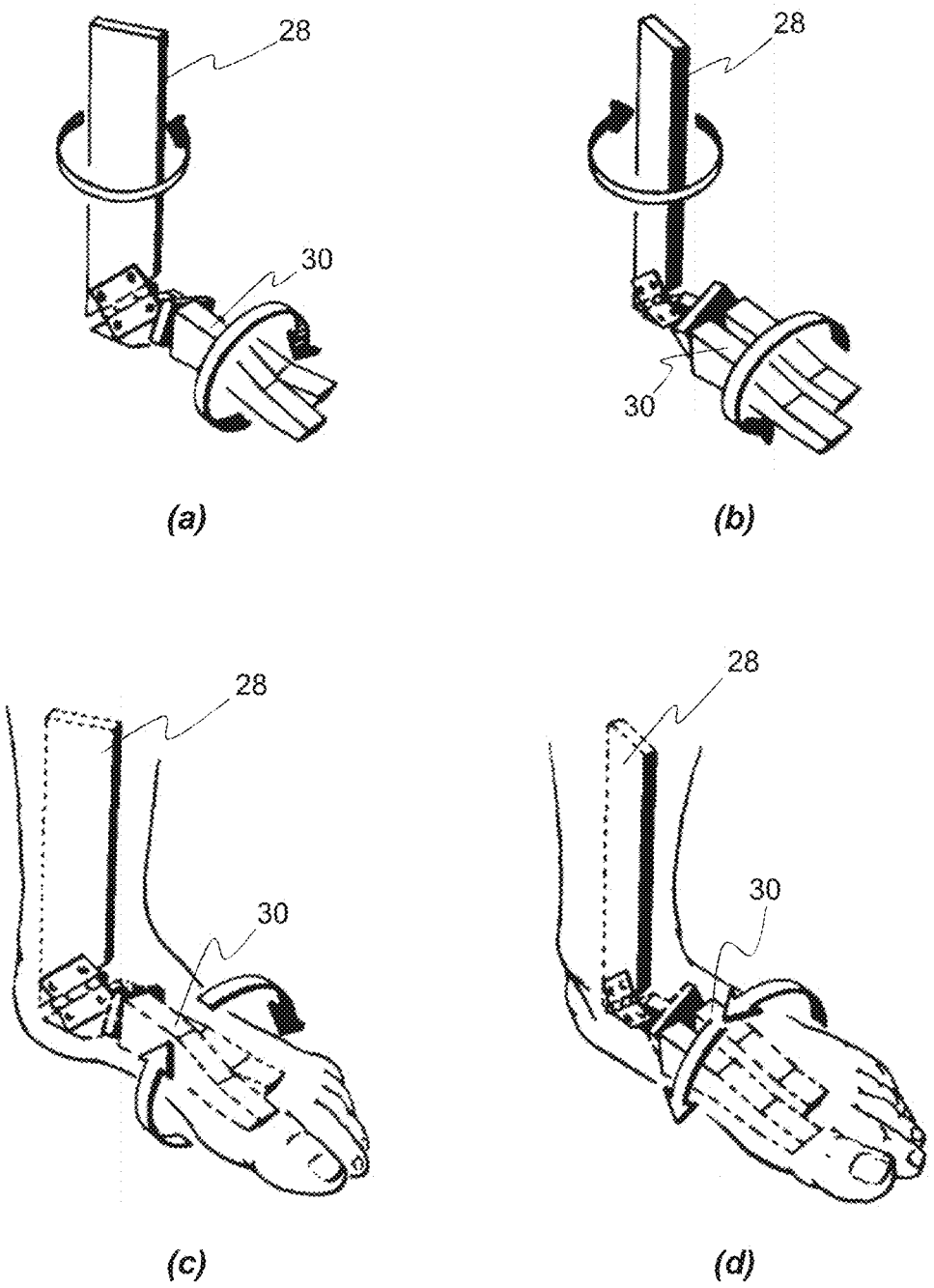
FIG. 3 (*a*) to (*d*) illustrates the schema of analogous mechanisms by which rotation of the tibia is transmitted through the subtalar joint into the foot.
Figure 4:
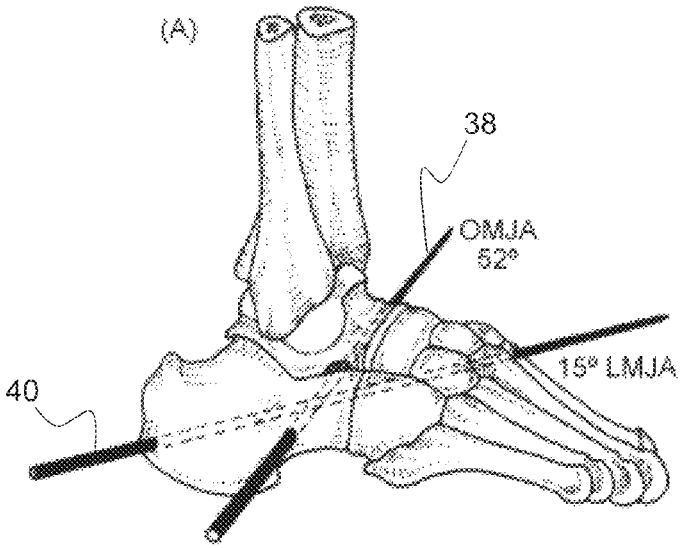
FIG. 4 shows an illustration of the midtarsal joint of a partial foot and its two axes of motion, i.e. the O.M.J.A. and the L.M.J.A., (a) from a lateral side view and (b) from a dorsal top view.
Figure 4:
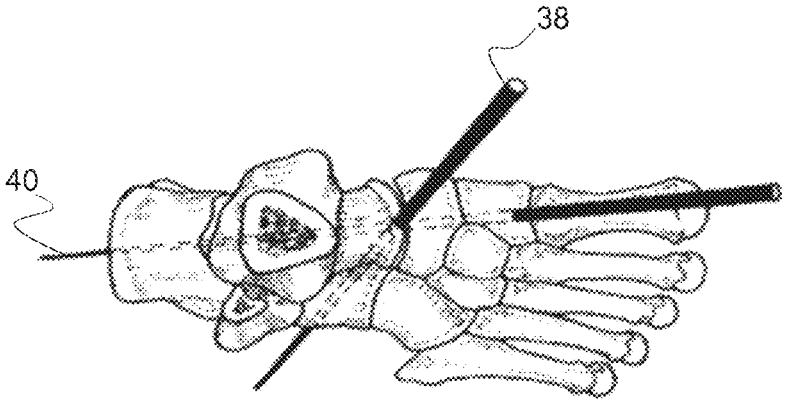

The exemplified embodiments of this invention will be described in relation to athletic footwear. However, it should be appreciated that, in general, the sole of the present invention will work equally well for any other suitable shoe.

Certain terminology is used in the following description for convenience only and is not limiting. The words 'right', 'left', 'lower', 'upper', 'front', 'rear', 'upward', 'down' and 'downward' designate directions in the drawings to which reference is made and are with respect to the described component when assembled and mounted. The words 'inner', 'inwardly' and 'outer', 'outwardly' refer to directions toward and away from, respectively, a designated centreline or a geometric centre of an element being described (e.g. central axis), the particular meaning being readily apparent from the context of the description.

Further, as used herein, the terms 'connected', 'attached', 'coupled', 'mounted' are intended to include direct connections between two members without any other members interposed therebetween, as well as, indirect connections between members in which one or more other members are interposed therebetween. The terminology includes the words specifically mentioned above, derivatives thereof, and words of similar import.

Further, unless otherwise specified, the use of ordinal adjectives, such as, 'first', 'second', 'third' etc. merely indicate that different instances of like objects are being referred to and are not intended to imply that the objects so described must be in a given sequence, either temporally, spatially, in ranking or in any other manner. Like reference numerals are used to depict like features throughout.

Also, directional adjectives are employed throughout this detailed description corresponding to the illustrated embodiments. For example, the term "longitudinal" refers to a direction extending a length of an article of footwear, that is, extending from a forefoot (i.e. anterior) portion to a heel portion. The term "forward" is used to refer to the general direction in which the toes of a foot point, and the term "rearward" may be used to refer to the opposite direction, i.e. the direction in which the heel of the foot is facing (posterior). A "lateral side" of an article of footwear may be the surface of the footwear that faces away from the other foot, wherein a "medial side" of an article of footwear may be the surface that faces towards the other foot. A "central area" of the sole may be an area between the "lateral side" and the "medial side" of the sole. The term "horizontal" refers to any direction substantially parallel with the ground surface. Also, in cases where the sole is planted flat on the ground surface, the horizontal direction may extend along the longitudinal direction of the surface of the sole.

The term "sole" can be taken to be either an integral sole, outsole or midsole or combination of the two, or a footbed or orthotic section which can be inserted into a shoe. The term "shoe" is intended to cover a variety of footwear including, but not limited to, athletic shoes, walking boots, football shoes, casual footwear or any other purpose-built footwear.

Figure 5:
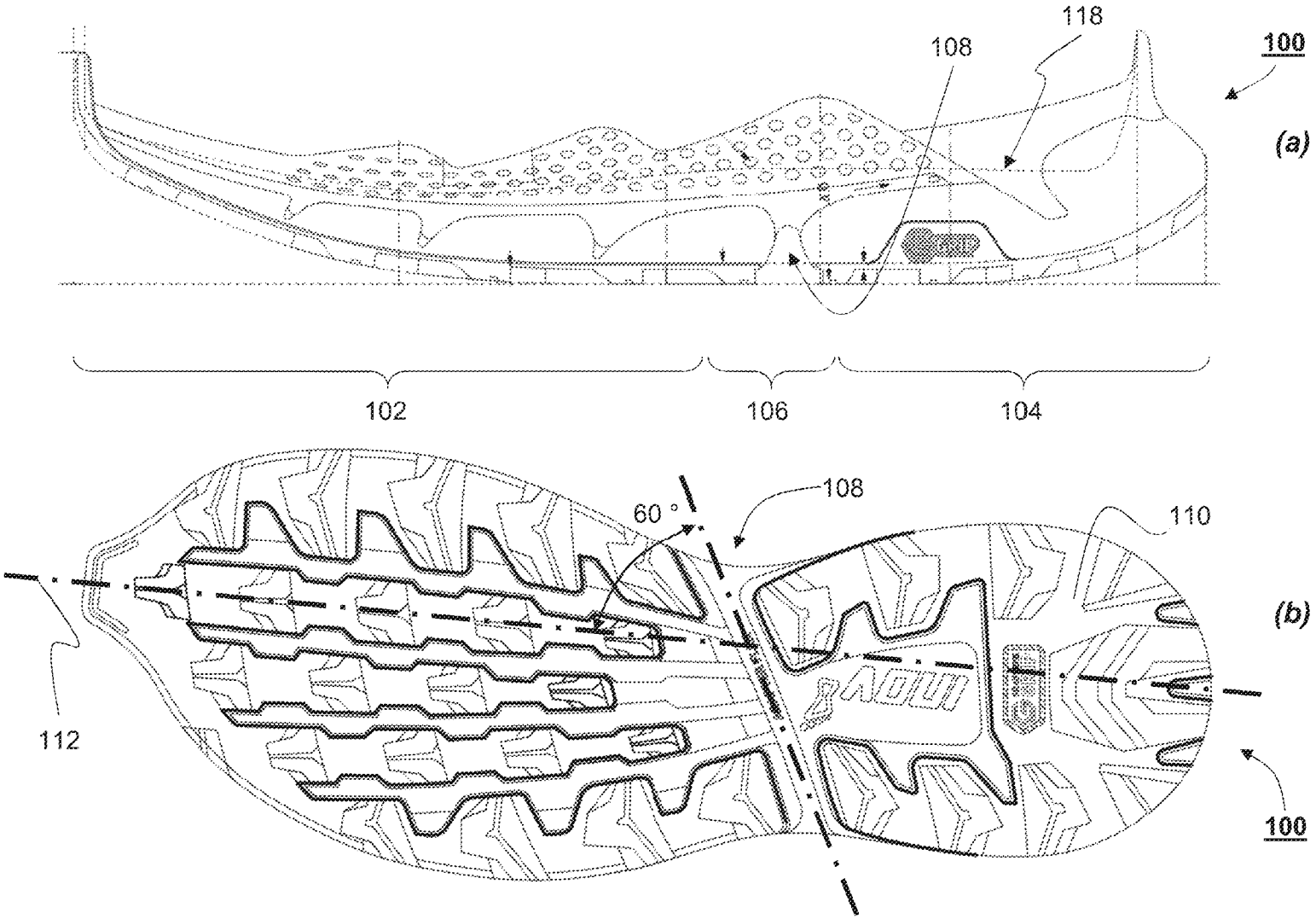
FIG. 5 shows an illustration of an example sole structure of the present invention including an articulation portion (a) from a lateral side view and (b) a plantar bottom view.

Referring now to FIG. 5, an example embodiment of the present invention is shown. Here, the sole 100 represents an outer sole, which may be layered with a mid-sole. However, it is understood by the person skilled in the art that the present invention may be incorporated in any one of at least one mid-sole or outer sole of a sole structure, or a combination of the mid-sole and the outer sole. The sole 100 may be formed from any suitable material. For example, a mid-sole may be formed from a foamed polymer material, such as polyurethane (PU), ethyl vinyl acetate (EVA), or any other suitable material, and the outer sole may be formed of any suitable polymer or composite material.

The sole 100 of this example embodiment comprises at least a forefoot portion 102 towards the distal end of the sole 100 and a rearfoot portion 104 towards the proximal end of the sole 100. An articulation portion 106 is provided so as to operably couple the forefoot portion 102 to the rearfoot portion 104.

In this particular example, the articulation portion 106 is provided by a groove 108 extending transversely between the medial and lateral side of the sole 100 at an angle of about 60° with respect to the longitudinal axis 112 of the sole 100. At this angle, the groove 108 is arranged synergeticly in line with the oblique midtarsal joint axis of the foot when in use, i.e. the groove 108 is orientated substantially in line with a normal projection of the oblique midtarsal joint axis (o.m.j.a.) onto the bottom surface 110 of the sole 100.

The groove 108 may have a depth 'd' in the region of half the sole thickness 't' (in this example the groove depth 'd' is ca. 10 mm) making the articulation portion 106 considerably thinner and more flexible than the adjacent forefoot portion 102 and the rearfoot portion 104. In particular, it is understood that the relative groove depth is in the region of 30%-45% of the total sole thickness. As a result, the sole allows for independent triplanar supination/pronation movement of the forefoot portion 102 relative to the rearfoot portion 104 when negotiating uneven terrain during running or walking. Therefore, the foot can follow its anatomically natural motion without interference from the sole 100.

The groove 108 may have a substantially V-shaped cross-section converging from a wider section at the bottom surface 110 into the sole structure 100. The converging end points of the groove 108 may be rounded, so as to optimise the stress distribution within the articulation portion 108 during relative movement between the forefoot portion 102 and the rearfoot portion 104. In particular, the cross-sectional profile of the groove 108 (such as the opening angle of the side surfaces 109) is shaped so as to minimise "lodging" of any debris (e.g. stones, twigs, dirt etc.) during use (see FIG. 6(*c*)).

It is understood by the person skilled in the art that any other suitable groove cross section may be used (e.g. U-shape), and that the groove 108 may have any depth 'd'(i.e. ≤ or ≥ half the sole thickness 't') and width 'w' suitable to operably decouple (i.e. allow relative movement between the forefoot portion 102 and the rearfoot portion 104 in line with the foot's triplanar motion pattern about the midtarsal joint) the forefoot portion 102 from the rearfoot portion 104 during use.

Figure 6:
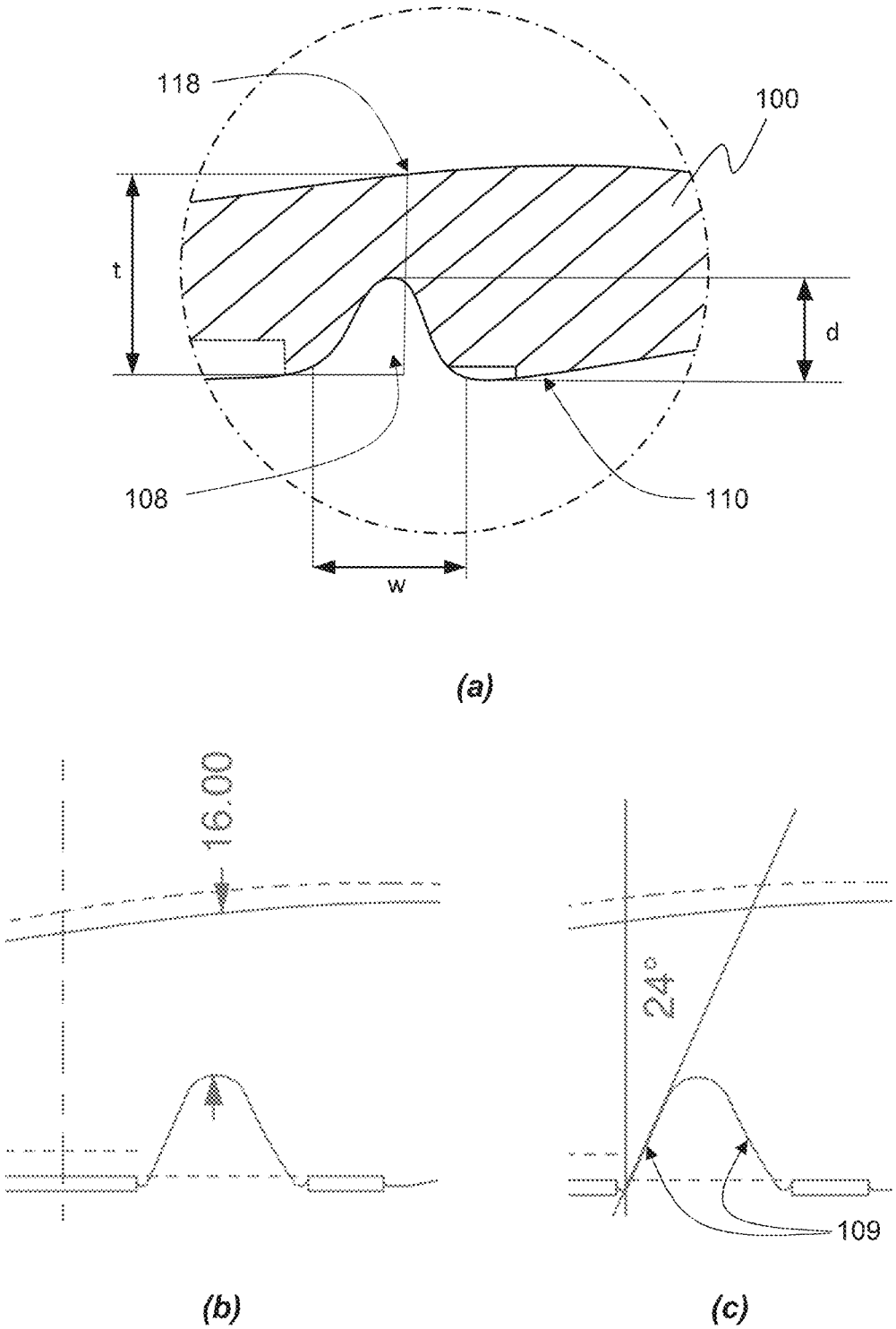
FIGS. 6 (*a*), (*b*) and (*c*) shows different illustrations of a close-up partial cross-section of the groove provided on the bottom surface of the sole.

FIG. 6 shows (a) a close-up partial cross-section of the groove 108 provided on the bottom surface 110 of the sole 100, as well as, (b) and (c) specific examples of sole thickness and side surface angle of the groove. In this particular example embodiment, the groove 108 depth is 10 mm and the midsole thickness at the deepest point of the groove 108 (including any potential protective or stabilising components, such as plates) is 16 mm. Thus, the groove depth accounts for ca. 38.5% of the thickness of the midsole at this point $$\left(\text{from: } \frac{10\text{ mm}}{(10\text{ mm} + 16\text{ mm})} \times 100\%\right).$$

In another example embodiment, the groove depth may be 8 mm, with a midsole thickness above the groove's deepest point of 14.2 mm giving a relative groove depth pf about 35.9%. Further, the angle of the side surface 109 of the groove 108 may be 24° (angular degrees) with respect to a vertical reference plane, but any other angle suitable to minimise "lodging" of debris may be used (e.g. an angle in the range of 20° to 30°). In addition, the groove of this particular example embodiment may be approximately 13 mm wide (at its widest point) with variations between different shoe sizes. Thus, as shown for example in FIG. 6(*a*), the groove may have a width between opposing side surfaces thereof that is greater than a depth thereof.

In an alternative example embodiment (not shown), a groove may be provided on the bottom surface 110 and a top surface 118 of the sole 100, so as to provide an even thinner midsection of the sole structure 100 that is in line with a normal projection of the oblique midtarsal joint axis of the foot during use. In yet another alternative example embodiment (not shown), the articulation portion 106 may be provided by a sole material having different material properties to the material used for the adjacent forefoot portion 102 and the rearfoot portion 104, i.e. a material that is considerably more flexible, softer and/or malleable than the adjacent sole material of the forefoot portion 102 and the rearfoot portion 104. Such a material will provide minimal resistance to the natural movement of the foot and therefore allow independent triplanar supination/pronation movement between the forefoot portion 102 and the rearfoot portion 104 in line with the anatomically natural supination/pronation of the foot provided by the oblique midtarsal joint.

In yet another alternative example embodiment (not shown), the articulation portion 106 may comprise a pivot joint operably coupling the forefoot portion 102 and the rearfoot portion 104 and configured to provide at least one axis of rotation between the forefoot portion 102 and the rearfoot portion 104 that is operably in line with at least the oblique midtarsal joint axis of the foot, or with a normal projection of the oblique midtarsal joint axis of the foot.

Figure 7:
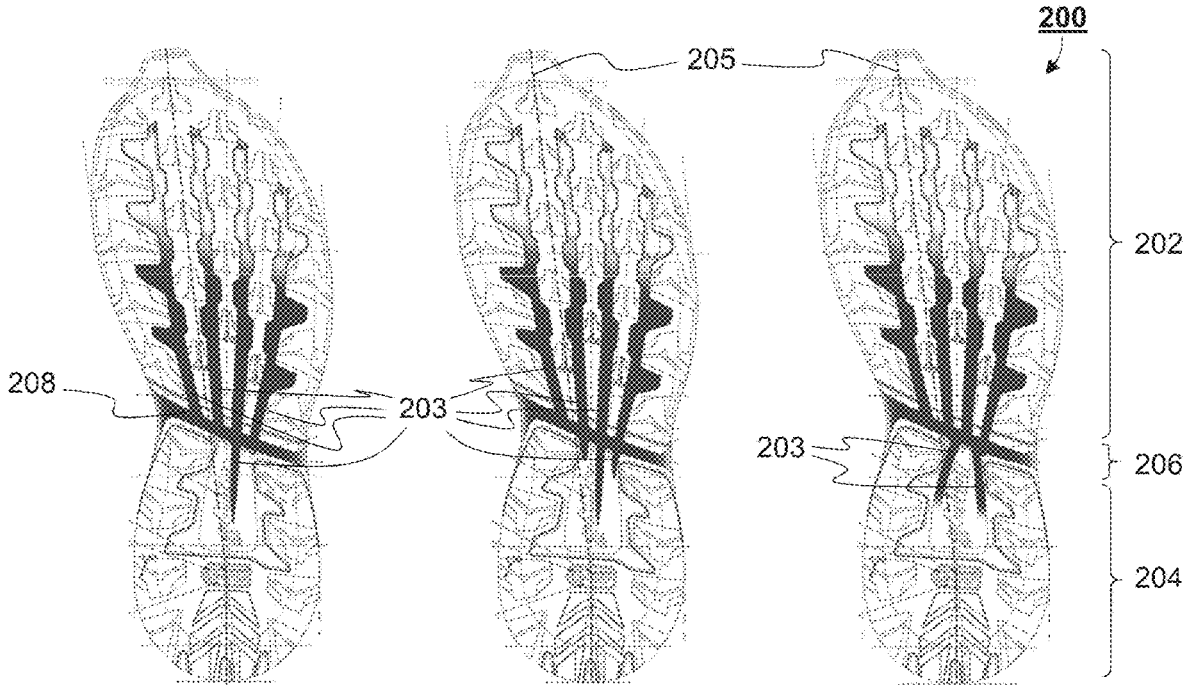
FIG. 7 shows (a) to (c) different versions of an alternative example embodiment of a sole structure further comprising longitudinal flexure grooves provided across the transverse groove of the articulation portion, and (c) a longitudinal cross-sectional view of the sole structure through one of the flexure grooves.
Figure 7:
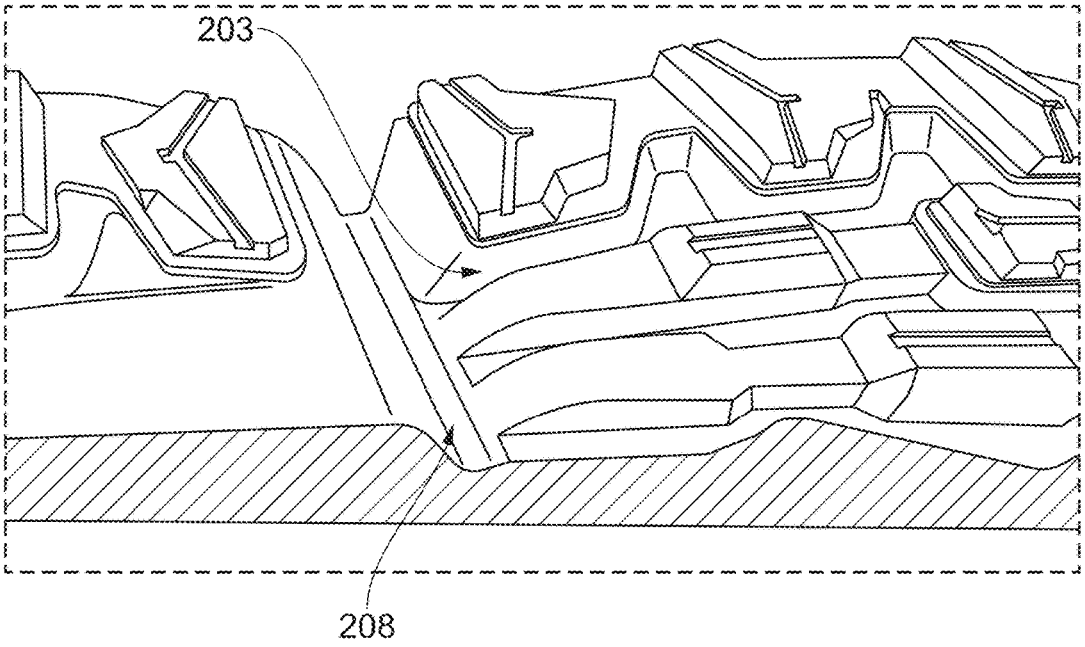

Referring now to FIGS. 7 (*a*)-(*d*), an alternative embodiment of the proposed invention. Here, a sole 200, having all the characterising features of the previously mentioned example embodiment as shown in sole 100, further comprises one or more additional flexure grooves 203 arranged in a direction substantially along the longitudinal axis 205 of the sole 200 and either merging (and ending) into, or crossing the transversely arranged groove 208 of the articulation portion 206 from the forefoot portion 202 into the rearfoot portion 204. These additional flexure grooves 203 are adapted to create structured "weak spots" allowing the topography of the sole 200 to change orientation in line with the midtarsal joint. Each one of the one or more flexure groove(s) 203 may be aligned with a predetermined axis of an anatomical feature of the foot, such as one that provides a specific anatomical motion. Also, each one of the one or more flexure groove(s) 203 may have a predetermined geometry configured to facilitate a specific anatomical motion of the foot. In particular, the one or more flexure groove(s) 203 may facilitate sagittal plane motion of the mid foot and forefoot. For example, the inclusion of a flexure groove 203 between the first and second metatarsal shaft extending anteriorly to the distal tip of the sole 200, and another flexure groove 203 between the third and fourth metatarsal shaft extending to the distal tip of the sole 200 can provide independent dorsiflexion and plantarflexion of individual columns of the foot, therefore, further facilitating decoupled movement between the forefoot portion 202 and the rearfoot portion 204.

Figure 8:
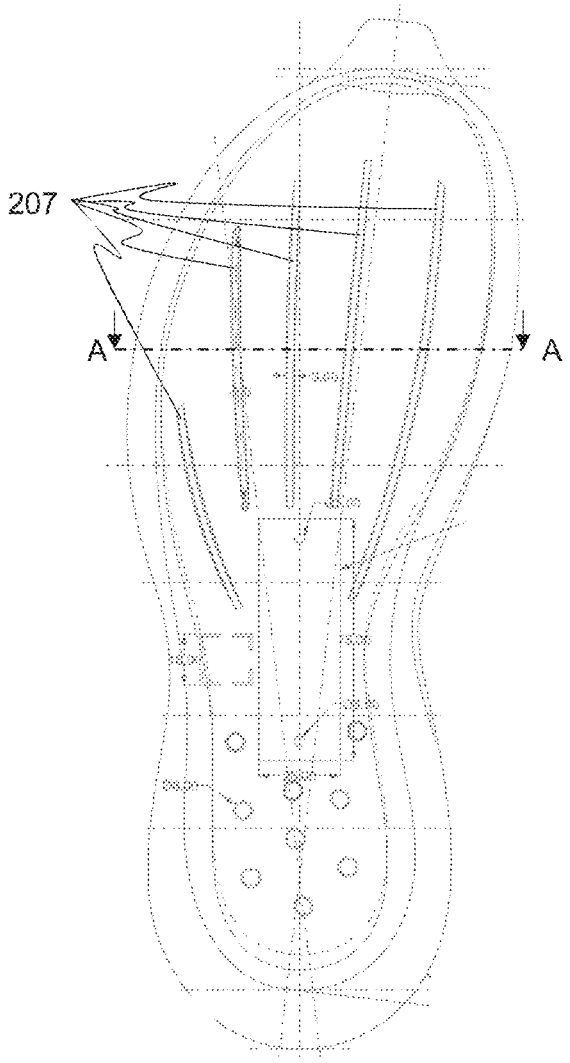
FIG. 8 shows (a) a top-view and (b) a cross-sectional front-view of the sole of the alternative example embodiment including top gage grooves provided in the forefoot portion of the sole.
Figure 8:
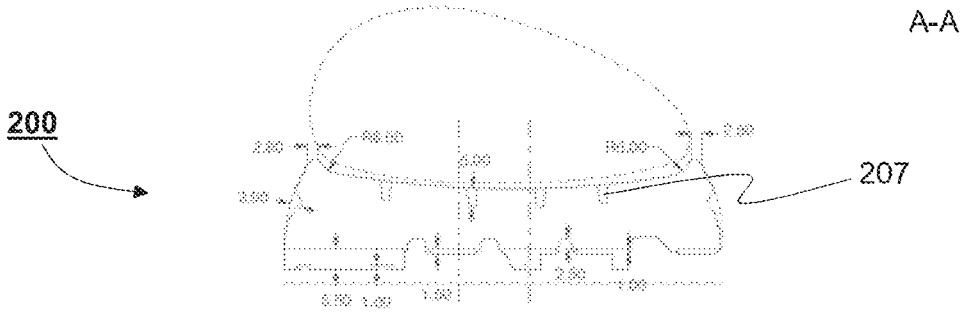

As shown particularly in FIGS. 7 (*a*)-(*d*), as well as, FIGS. 8 (*a*), (*b*), the depth of the flexure groove(s) 203 may "fade" from the depth of the transverse groove 208 to a predetermined "shallower" depth (or even to the surface level) over a predetermined length of the flexure groove(s) 203. In particular, flexure grooves 203 extending into the rearfoot portion 204 "fade" back to the surface level (e.g. over a length of about 5 mm-15 mm.

FIG. 8 shows (a) a top-view and (b) a cross-sectional (A-A) front-view of the sole 200. The forefoot portion 202 may further comprise top gage longitudinal groves 207, for example, up to 5 mm deep into the midsole and "fading" back up to the surface level on opposing ends.

Figure 9:
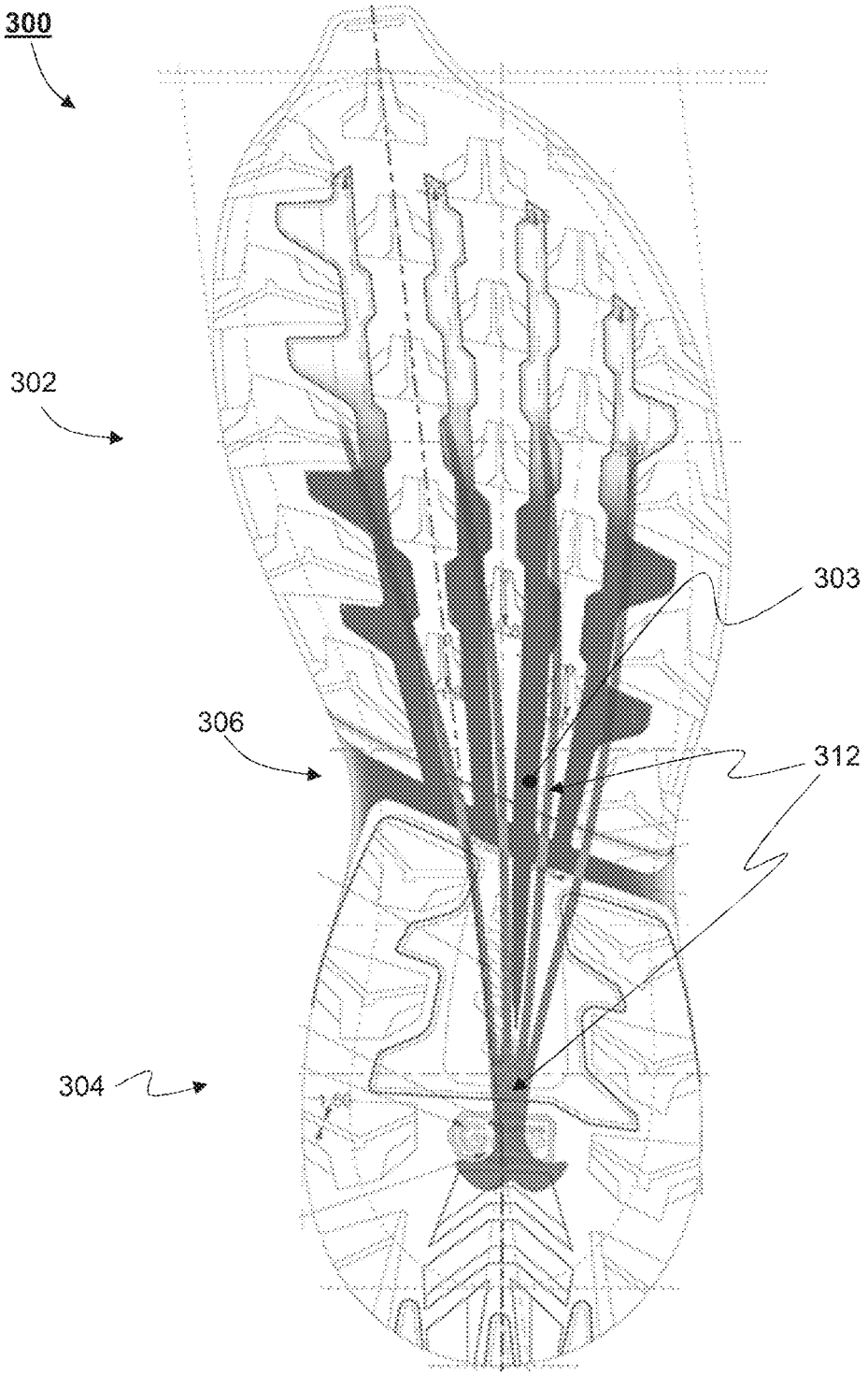
FIG. 9 shows a schematic bottom-view of a sole of another alternative example embodiment further comprising a Dynamic Fascia Band feature operably incorporated within the sole structure.

Referring now to FIG. 9, another alternative embodiment of the present invention includes a sole 300 comprising any one of the features of the other two soles 100, 200. In addition to the articulation portion 306, the one or more flexure groove(s) 303 and top gage longitudinal grooves (not sown, at top surface of midsole, see 207), the sole comprises a Dynamic Fascia Band (DFB) feature 312 as described, for example, in EP1906783A1. The Dynamic Fascia Band 312 is operably incorporated into the sole 300 between the forefoot portion 302 and the rearfoot portion 304 in synergy with the articulation portion 306, as well as, any one of the flexure grooves 303 and top gage longitudinal grooves (not shown). It is understood by the person skilled in the art that the sole 300 may include any combination of the flexure groove(s) 303, the top gage grooves (not shown) with the articulation portion 306 and the dynamic fascia band 312.

Figure 10:
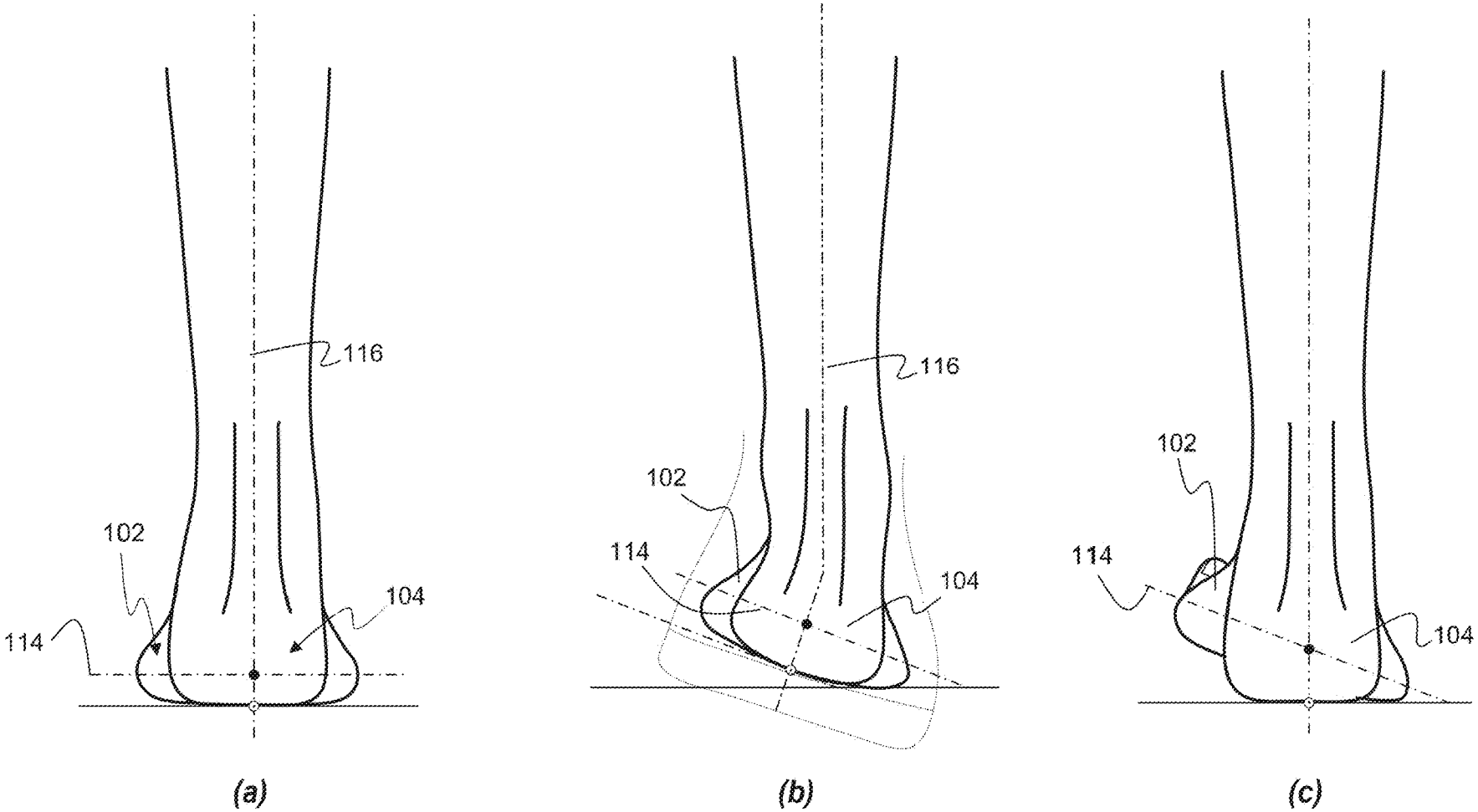
FIG. 10 is an illustration of a rear view of the a foot engaging with a ground surface during walk or running (a) forefoot and rearfoot are in a neutral relationship, (b) forefoot and rearfoot are coupled by a typically stiff shoe and sole so that the rotation of the forefoot is transferred to the rearfoot, and (c) forefoot and rearfoot movement with a sole structure of the present invention, decoupling forefoot and rearfoot so as to allow invert movement of the forefoot relative to the rearfoot.

FIGS. 10 (*a*) to (*c*) illustrate differences in the relative movement between the forefoot portion 102 and the rearfoot portion 104 during use with any one of the different embodiments of the sole 100, 200, 300 of the present invention and with a stiffer, commonly used sole. For simplicity, reference is only made to the first example embodiment of sole 100, but it is understood that the differences between relative movement is equally valid for the embodiments of sole 200 and 300. Further, for illustration purposes, the differences are described with reference to the foot only, i.e. not showing the shoe or sole.

FIG. 10 (*a*) shows the foot on flat ground or when standing, i.e. in a neutral position, where the transverse axis 114 of the forefoot portion 102 is perpendicular (i.e. 90°) to the bisection axis 116 of the rear foot 104, i.e. there is no relative supination/pronation movement between the forefoot 102 and the rearfoot 104. FIG. 10(*b*) illustrates a scenario when using a typical sole without an articulation portion, such as the articulation portion 106 provided by the sole 100 of the present invention. During walking or running over uneven terrain, the effected inward twist of the forefoot 102 is transferred (i.e. coupled) to an inward twist of the rearfoot 104, i.e. rotation angles $\alpha$ and $\gamma$ of respective transverse axes are the same or similar. FIG. 10(*c*) illustrates a scenario when using the sole of the present invention during walking or running over uneven terrain. Here, the forefoot 102 is allowed to naturally invert without affecting the rearfoot 104, therefore, allowing the foot to naturally adapt to the terrain, potentially leading to less work required from respective muscles to absorb forces that are transferred from the uneven terrain through the foot into the leg. Also, because the forefoot 102 and the rearfoot 104 are operably decoupled, i.e. movement of the forefoot portion 102 does not affect (or at least only minimally affect) the rearfoot portion 104, lateral strain on the ankle joint from supination/pronation of the foot during running or walking may be reduced, potentially preventing ankle injuries.

It will be appreciated by persons skilled in the art that the above embodiments have been described by way of example only and not in any limitative sense, and that various alterations and modifications are possible without departing from the scope of the invention as defined by the appended claims.

The invention claimed is:

1. A sole structure for a shoe, the sole structure having a bottom surface, a top surface, and a thickness extending between the bottom surface and the top surface, the sole structure comprising:

a forefoot sole portion, arranged towards a distal end along a longitudinal central axis of said sole structure;

a rearfoot sole portion, arranged towards a proximal end along said longitudinal central axis of said sole structure; and only a single articulation portion, adapted to operably couple said forefoot sole portion and said rearfoot sole portion, so as to allow relative movement between said forefoot sole portion and said rearfoot sole portion during use, said single articulation portion being configured to allow for inversion and/or eversion movement of said forefoot sole portion independent of said rearfoot sole portion, said single articulation portion comprising only a single groove structure extending from a medial side of said sole structure to a lateral side of said sole structure and having a width between opposing side surfaces of the single groove structure at a widest point of said single groove structure, said width at said widest point of said single groove structure being greater than a depth of said single groove structure, said depth of said single groove structure being about 35.9% or about 38.5% of said thickness of said sole structure, said single groove structure having opposing side surfaces oriented at a first angle of about 24 degrees relative to a vertical plane.

2. A sole structure according to claim 1, wherein said single groove structure is oriented at a second angle in the range of 40° to 80° relative to said longitudinal central axis.

3. A sole structure according to claim 2, wherein said second angle is in the range of 50° to 70° relative to said longitudinal central axis.

4. A sole structure according to claim 3, wherein said second angle is 60° relative to said longitudinal central axis.

5. A sole structure according to claim 2, wherein said width and depth of said single groove structure is configured to allow movement between said forefoot sole portion and said rearfoot sole portion, during use.

6. A sole structure according to claim 2, wherein said single groove structure is provided on the bottom surface of said sole structure.

7. A sole structure according to claim 2, wherein said single groove structure has a substantially inverted U-shaped or inverted V-shaped cross section.

8. A sole structure according to claim 1, wherein said single articulation portion comprises a pivot joint having an axis of rotation parallel to a normal projection of an oblique midtarsal joint axis of a foot onto said bottom surface, during use.

9. A sole structure according to claim 1, further comprising at least one longitudinal flexure feature having a longitudinal axis that is oriented substantially parallel to said longitudinal central axis and operably coupled with said single articulation portion.

10. A sole structure according to claim 9, wherein said at least one longitudinal flexure feature is a longitudinal flexure groove extending from said forefoot sole portion towards and at least mergingly into said single articulation portion.

11. A sole structure according to claim 10, wherein said longitudinal flexure groove is spaced apart from said medial side and said lateral side of said sole structure.

12. A sole structure according to claim 1, wherein the width at the widest point of the single groove structure is approximately 13 mm.

13. A sole structure for a shoe, the sole structure having a bottom surface, the sole structure comprising:

a forefoot sole portion, arranged towards a distal end along a longitudinal central axis of said sole structure, said forefoot sole portion having a width between a medial side and a lateral side of said sole structure;

a rearfoot sole portion, arranged towards a proximal end along said longitudinal central axis of said sole structure, the rearfoot sole portion having a width between said medial side and said lateral side of said sole structure;

only a single articulation portion disposed between said forefoot sole portion and said rearfoot sole portion, said widths of said forefoot sole portion and said rearfoot sole portion tapering towards said single articulation portion such that said single articulation portion has a width that is narrower than widest portions of said forefoot sole portion and said rearfoot sole portion, said single articulation portion comprising only a single groove structure having a depth that is about 35.9% or about 38.5% of a thickness of said sole structure; and at least one longitudinal flexure groove having a longitudinal axis that is substantially parallel to said longitudinal central axis, said at least one longitudinal flexure groove extending from said forefoot sole portion towards and at least mergingly into said single articulation portion, said at least one longitudinal flexure groove having a depth that decreases from a first depth adjacent to said single groove structure to a second, shallower depth 5 mm to 15 mm away from said single groove structure.

14. A sole structure according to claim 13, wherein said at least one longitudinal flexure groove extends from said forefoot sole portion, crossing said single articulation portion and into said rearfoot sole portion.

15. A sole structure according to claim 13, wherein said at least one longitudinal flexure groove is configured to be operably aligned with a predetermined anatomical feature of a foot.

16. A sole structure according to claim 15, wherein the predetermined anatomical feature of the foot is a feature responsible for a specific motion within the foot.

17. A sole structure according to claim 13, wherein said single groove structure has an inverted V-shape with side surfaces angled at about 24 degrees relative to a vertical plane.

18. A sole structure according to claim 13, wherein said single groove structure has a width of about 13 mm.

19. A sole structure for a shoe, the sole structure having a bottom surface, the sole structure comprising:

a forefoot sole portion, arranged towards a distal end along a longitudinal central axis of said sole structure, said forefoot sole portion having a width between a medial side and a lateral side of said sole structure;

a rearfoot sole portion, arranged towards a proximal end along said longitudinal central axis of said sole structure, the rearfoot sole portion having a width between said medial side and said lateral side of said sole structure;

only a single articulation portion disposed between said forefoot sole portion and said rearfoot sole portion, said widths of said forefoot sole portion and said rearfoot sole portion tapering towards said single articulation portion such that said single articulation portion has a width that is narrower than widest portions of said forefoot sole portion and said rearfoot sole portion, said single articulation portion being adapted to operably couple said forefoot sole portion and said rearfoot sole portion, so as to allow relative movement between said forefoot sole portion and said rearfoot sole portion during use, said single articulation portion comprising only a single groove structure extending from said medial side to said lateral side of said sole structure and having a width between opposing side surfaces of the single groove structure, the width at a widest point of the single groove structure being greater than a depth of the single groove structure, said depth of said single groove structure being about 35.9% or about 38.5% of a thickness of said sole structure, said single groove structure having opposing side surfaces oriented at an angle of about 24 degrees relative to a vertical plane, said single groove structure being configured to allow for inversion and/or eversion movement of said forefoot sole portion independent of said rearfoot sole portion; and at least one longitudinal flexure groove having a longitudinal axis that is substantially parallel to said longitudinal central axis, said at least one longitudinal flexure groove extending from said forefoot sole portion towards and at least mergingly into said single articulation portion, said at least one longitudinal flexure groove having a depth that decreases from a first depth adjacent to said single groove structure to a second, shallower depth 5 mm to 15 mm away from said single groove structure.

* * * * *